US006158632A

United States Patent [19]

Ekkert

[11] Patent Number: 6,158,632

[45] Date of Patent: Dec. 12, 2000

[54] CLOSURE WITH RECESSED HINGED COVER

[75] Inventor: Len Ekkert, Lemont, Ill.

[73] Assignee: Phoenix Closures, Inc., Ill.

[21] Appl. No.: 09/394,754

[22] Filed: Sep. 13, 1999

[51] Int. Cl.[7] ..... B67D 3/00; B65D 51/18; B65D 43/18

[52] U.S. Cl. ..... 222/556; 220/254; 220/259; 220/832

[58] Field of Search ..... 222/556, 498, 222/546; 220/254, 259, 832, 831, 711, 713; 215/235

[56] References Cited

U.S. PATENT DOCUMENTS

| | | | |
|---|---|---|---|
| 3,140,019 | 7/1964 | Barr . | |
| 3,836,056 | 9/1974 | Pehr . | |
| 4,127,212 | 11/1978 | Waterbury | 220/254 |
| 4,284,200 | 8/1981 | Bush et al. . | |
| 4,607,768 | 8/1986 | Taber et al. . | |
| 4,723,693 | 2/1988 | DeCoster . | |
| 4,898,292 | 2/1990 | VerWeyst et al. . | |
| 4,989,746 | 2/1991 | Pierce | 220/254 |
| 5,110,002 | 5/1992 | Tucker | 220/254 |
| 5,125,525 | 6/1992 | Tucker | 220/254 |
| 5,139,181 | 8/1992 | VerWeyst . | |
| 5,462,189 | 10/1995 | Pierce | 220/254 |
| 5,799,838 | 9/1998 | Miller . | |

*Primary Examiner*—Kevin Shaver
*Assistant Examiner*—D Austin Bonderer
*Attorney, Agent, or Firm*—Welsh & Katz, Ltd.

[57] ABSTRACT

A closure is configured for sealing engagement with an associated container, and includes a recessed, hinged cover. The closure has a circular top wall portion defining an edge region. A channel is formed in the top wall portion extending to the edge region. The channel defines an open end and a closed end and is formed by a pair of side walls and a bottom wall. A dispensing opening is formed in the channel bottom wall. An annular skirt depends from the top wall portion at about the edge region and includes a container engaging portion for engaging the container. A cover is pivotally connected to the top wall portion for movement within the channel between an open position wherein the cover is pivoted away from the dispensing opening and a closed position wherein the cover overlies the dispensing opening and extends to about the channel open end.

14 Claims, 1 Drawing Sheet

CLOSURE WITH RECESSED HINGED COVER

FIELD OF THE INVENTION

This invention pertains to container closures. More particularly, this invention pertains to dispensing closures having a pivoting tab or cover for closing the container opening, which cover is recessed within the closure.

BACKGROUND OF THE INVENTION

Dispensing closures are made in a wide variety of shapes and sizes for various applications. For example, one dispensing closure having dual independently pivoting flaps, such as that disclosed in U.S. Pat. No. 5,799,838 to Miller can be used for spices and the like for sprinkling or spooning the contents from the container.

Another type of dispensing closure is that commonly found on coffee creamers, such as a coffee lightener includes a fixed top that is sealed to the container that has an opening that extends across part of the top. This type of closure includes a rotatable disk having, for example, one large opening and a plurality of smaller openings. The openings can be rotated so that they are positioned over the container opening for dispensing the container contents. Generally, the rotatable disk includes a closed area that can be positioned over the opening to seal the container. The disk can be rotated so that the large opening are aligned with the container opening to spoon the contents from the container. Likewise, the disk can be rotated so that the smaller openings are aligned with the container opening to sprinkle contents from the container. In a typical arrangement, the disk rotates about a pivot that extends from the disk into the central portion of the container cover.

Although these rotatable closures are widely used and accepted in the industry, their use may be limited in application. Another type of closure that is used for dispensing includes a simple, hinged tab or cover that seals against the top of the closure and pivots upwardly to uncover and opening from which the contents of the container can be dispensed. The hinge arrangement of these raised covers generally includes a thinned or weakened plastic or polymeric portion that is formed as part of and extending between the closure top wall and the cover. While this type of closure is also well known, because it uses a weakened area of plastic, it can fail, crack or separate from the closure top wall.

Consumers will recognize the wide array of different types of closures and particularly sealable closures that are known in the marketplace. However, few of these closures are made sufficiently strong and durable so that they can be reused time and again.

Another drawback to many such closures is that they may not provide a seal of the container contents from the environs. To this end, the sealing surfaces between the closure cover and the top wall of the closure should be designed to maintain the contents sealed, free from contamination, and to prevent spillage in the event that the container is overturned or dropped.

Accordingly, there exists a need for a container closure that provides a positive seal for the contents from the environs. Desirably, such a closure includes a hinge or pivoting cover arrangement that does not weaken the connection between the cover and the closure body. Most desirably, the cover of such a closure locks into both the open and closed positions so that the contents can be dispensed without having to hold the cover in the open position, and provides audible indication when the cover is locked into both the open and closed positions.

SUMMARY OF THE INVENTION

A closure is configured for sealing engagement with a container and includes a recessed, hinged cover. The closure has a circular top wall portion that defines an edge region. A channel is formed in the top wall portion and extends to the edge region defining an open end. The channel is formed by a pair of side walls and a bottom wall. A dispensing opening is formed in the top wall portion at the channel bottom wall. The closure includes an annular skirt depending from the top wall portion at about the edge region. The skirt includes a container engaging portion for engaging the container.

A cover is pivotally connected to the top wall portion for movement within the channel between an open position wherein the cover is pivoted away from the dispensing opening and a closed position wherein the cover overlies the dispensing opening. In a current embodiment, engaging elements are formed on the top wall portion and formed on the cover for securing the cover in the open position and in the closed position. In a preferred embodiment, the cover engaging elements include a projection extending from a side of the cover and the top wall portion engaging elements include a first cooperating channel projection formed in the channel wall to secure the cover in the open position and a second channel projection formed in the channel side wall spaced from the first channel projection to secure the cover in the closed position.

The cover is connected to the top wall portion by a pair of hinge pins extending outwardly from the cover that insert into a pair of recesses formed in the side walls of the channel. Preferably, the hinge receiving recesses formed in the side walls channel are sealed.

In a preferred embodiment, the channel defines a closed end opposingly spaced from the open end. In this embodiment, the cover is positioned within the channel to extend to the edge region of the top wall portion at the open end when in the closed position. When the cover is pivoted to the open position, it extends to a location within the channel spaced from the closed end. In this embodiment, the pivoting axis of the cover is parallel to and spaced from a diameter line across the closure.

Preferably, the top wall portion has a generally domed shape, sloping downwardly circumferentially at about the edge region, and the cover has a complementary shape that slopes downwardly at an end toward the edge region when in the closed position to conform to the shape of the top wall portion. When the cover is so configured, and when in the open position, the end of the cover extends upwardly from the bottom wall of the channel to define a gap between the end of the cover and the channel bottom wall for a user to positioned a finger under the cover to facilitate urging the cover from the locked open position.

Most preferably, the closure defines a recessed region at about a juncture of the top wall portion and the skirt, adjacent to and below the cover, so that when the cover is closed a gap is defined between the juncture and the cover for a user to position a finger under the cover to facilitate urging the cover from the locked closed position.

The dispensing opening can be formed having a predetermined shape and the cover can include a sealing element extending therefrom having a shape complementary to the shape of the dispensing opening to enhance the seal between the dispensing opening and the cover.

Other features and advantages of the present invention will be apparent from the following detailed description, the accompanying drawings and the appended claims.

DETAILED DESCRIPTION OF THE PREFERRED EMBODIMENTS

Figure 1:
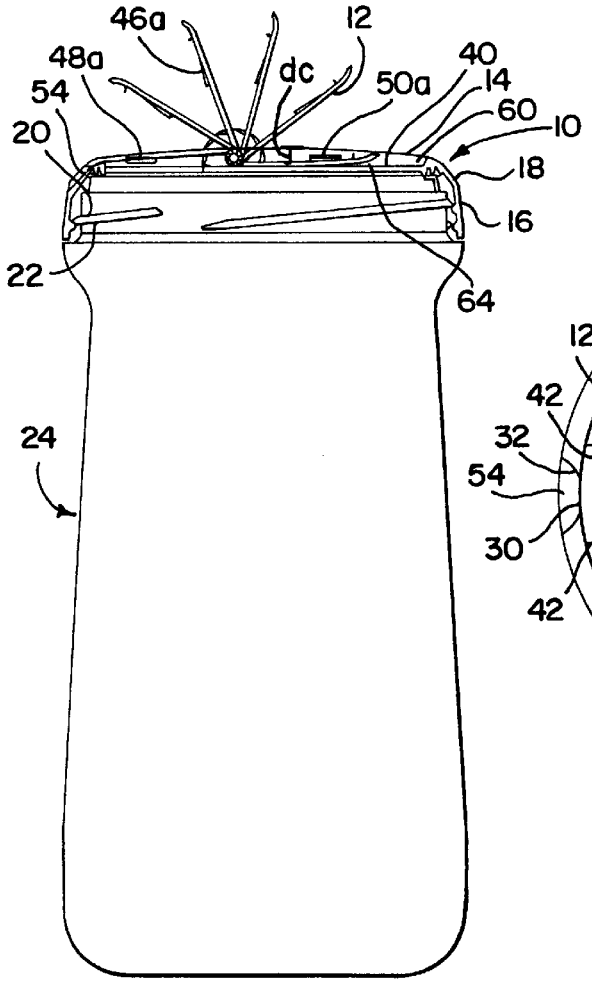
FIG. 1 is a front view of an exemplary container having a closure with a recessed hinged cover embodying the principles of the present invention, the cover being illustrated in various stages of pivoting between the open and closed positions.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and in particular to FIG. 1, there is shown a closure 10 having a recessed, hinged cover 12 in accordance with the principles of the present invention. The closure 10 includes a circular top wall portion 14 and a depending annual skirt 16 contiguous with and extending from about an edge 18 of the top wall portion 14. The skirt 16 includes a container engaging arrangement 20, such as the illustrated threads formed internally of the skirt 16 that engage complimentary threads 22 on the container 24. Those skilled in the art will recognize that a wide variety of engaging arrangements are known for use in engaging the closure 10 with the container 24, such as bayonet-type closures and snap-type closures. These other arrangements are within the scope of the present invention.

The closure 10 includes a dispensing opening 26 formed in the top wall portion 14, spaced from the skirt 16. The dispensing opening 26 can be formed to facilitate pouring, spooning or sprinkling the contents from the container 24. In the illustrated embodiment, the opening 26 is formed having a tear-drop-like shape to facilitate pouring the contents from the container 24.

The opening 26 is sealed by the cover 12. In a preferred embodiment, the cover 12 is recessed within a channel 28 formed in the top wall 14 that extends on one side, to an edge of the top wall portion 14 at about a juncture with the skirt 16, indicated generally at 30, and defines an open end 32 of the channel 28. The channel 28 is configured to receive the cover 12 which pivots between a closed position in which the cover 12 overlies the dispensing opening 26, and an open position in which the cover 12 is moved away from the dispensing opening 26 to provide access to the opening 26. In a preferred arrangement, the cover 12 locks into both the closed and open positions, and provides audible indication, such as a "click" sound, to indicate that the cover 12 is in the open or closed state. The channel is defined by a bottom wall 40 and a pair of side walls 42.

Figure 5:
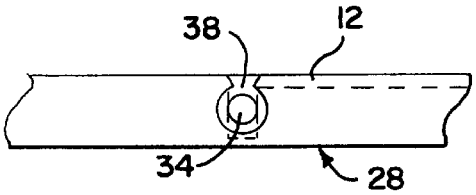
FIG. 5 is a partial side view of the hinge arrangement, illustrated with the cover in phantom.

The cover 12 is mounted to the top wall 14 by a hinge 33 having a pair of hinge pins 34 that extend outwardly from sides or edges 36 of the cover 12 and are engaged by hinge slots 38 or openings formed in the top wall 14. In a present embodiment, the hinge slots 38 are sealed and are contiguous with the sides 42 of the channel 38. In a most preferred arrangement, the hinge slots 38 are rounded and have open top regions, as illustrated in FIG. 5, to readily permit receipt of the pins 34 within the slots and to readily permit rotation of the pins 34 within the slots 38. Preferably, the cover 12 has a thickness $t_v$ that is about equal to the depth $d_c$ of the channel 28, so that when the cover 12 is closed, it lies flush with an upper surface 44 of the top wall 14. This arrangement facilitates stacking containers 24 one on another for merchandising, display and the like.

The width $w_c$ of the channel 28 is configured so that when the cover 12 is open, it can be urged and locked into the channel 28 by engagement of the cover locking elements 46 which engage locking elements 48 in the channel 28 that are positioned at about the dispensing opening 26. This facilitates locking or securing the cover 12 in the closed position. Locking elements 50 are also positioned in the opposing end of the channel 28 to lock the cover 12 in the open position.

Figure 3:
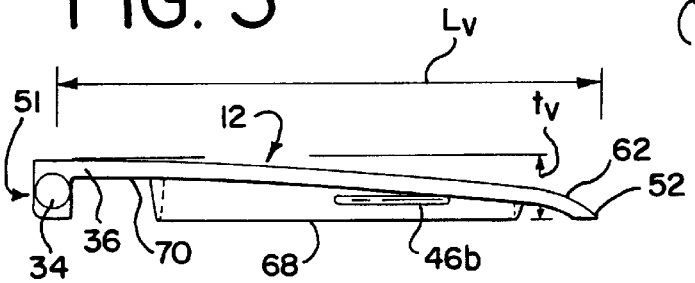
FIG. 3 is a side view of the cover illustrating the plug wall.

In one embodiment, the cover engaging elements 46 are formed as a pair of cover projections or blocks 46*a,b* that extend outwardly from the cover 12 and two pairs of channel blocks 48*a,b* and 50*a,b* that extend inwardly from the side walls 42 of the channel 28. The first pair of channel blocks 48*a,b* is positioned between the hinge 33 and the channel open end 32 to engage the cover blocks 46*a,b* when the cover 12 is closed, and the second pair of channel blocks 50*a,b* is positioned between the hinge 33 and the opposing end of the channel 28 to engage the cover blocks 46*a,b* when the cover 12 is open. As will be readily understood, the cover 12 has a width $w_v$ (exclusive of the locking elements 46) that is less than the width $w_c$ of the channel 28. As seen in FIG. 3, the portion of the cover 12 rearward of the pins 34, as generally indicated at 51, is configured or sized to permit unobstructed pivoting of the cover 12 within the channel 28.

Figure 2:
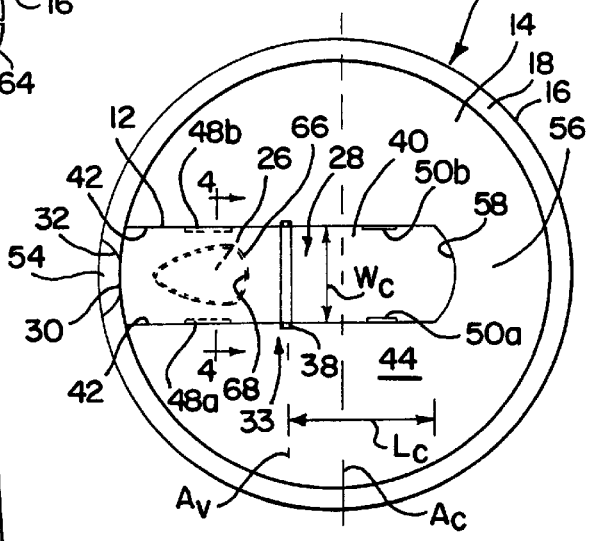
FIG. 2 is a top view of the closure showing the cover in the closed position, and further showing the closure opening and cover plug wall in phantom lines.
Figure 4:
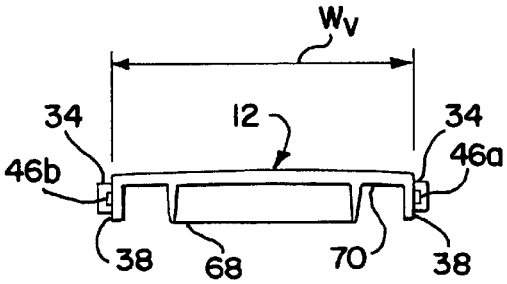
FIG. 4 is a cross-sectional view of the cover taken along line 4—4 of FIG. 2.

In the embodiment of the closure 10 illustrated in FIGS. 1 and 2, it will be seen that the pivoting axis $A_v$ of the cover 12 (i.e., at the hinge 33) is parallel to and offset from the center $A_c$ or axis of (i.e., a diameter line extending across) the closure 10. In this arrangement, when the cover 12 is in the closed position, the edge 52 of the cover 12 lies flush with the edge 18 of the top wall portion 14 at the juncture 30 with the skirt 16. To facilitate grasping or urging the cover 12 from the closed position, a concave recess 54 can be formed in closure 10 at the top wall-skirt juncture 30, immediately below the cover edge 52. The recess 54 facilitates opening the cover 12 by permitting a user to place their finger under the cover edge 52 to urge the cover 12 upward to expose the dispensing opening 26.

As provided above, when in the open position, the cover 12 does not extend to the edge 18 of the top wall 14. Rather, the cover edge 52 is spaced from the top wall edge 18 and from a closed, inner end 56 of the channel 28. That is, the channel length $L_c$ from the pivot axis $A_v$, rearward (toward the open position) is longer than the length $L_v$ of the cover 12. This permits the cover 12 to be fully received within the channel 28 so that when the cover 12 is locked into the channel 28 in the open position, it is flush with, or below the upper surface 44 of the top wall portion 14. This arrangement also provides a secure, positive locking configuration for the cover 12 in the open position. In a most preferred embodiment, the closed end 56 of the channel 28 includes a rounded wall, indicated generally at 58, that is contiguous with the channel side walls 42 and defines a space 60 between the cover edge 52 and the end of the channel 58 as the cover 12 lies in the channel 28. This area provides sufficient space for a user to position a finger on the cover edge 52, to grasp the cover 12 and urge it from the locked open position.

In a preferred configuration, the closure 10 slopes at the edge 18 at the top wall-skirt juncture, or generally the closure 10 has an overall domed shape. In such a configuration, the cover 12 likewise has a sloped edge, indicated generally at 62, to conform to or to compliment the domed shape of the closure 10. This shape further facilitates releasing the cover 12 from the open position because when the cover 12 is locked open, the sloped edge 62 rests against the flat surface of the channel bottom wall 40 and is oriented upward (i.e., upside-down). This upward orientation positions the slope of the cover 12 against the channel bottom wall 40 and thus results in a space, indicated at 64 in FIG. 1, between the cover 12 and the channel bottom wall 40 to permit a user to place a finger below the cover 12 to release it from the channel 28.

In a most preferred embodiment of the closure 10, as best seen in FIGS. 1 and 2, the dispensing opening 26 is formed having a raised lip or edge 66. The cover 12 has a complementary or matingly shaped lip 68 on an inner surface 70 of the cover 12. The mating lips 66, 68 provide an enhanced seal to protect the container contents from the environs and to prevent contents that may be resting on the closure surface from falling back into the container 24.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A closure having a recessed, hinged cover, the closure configured for sealing engagement with an associated container, the closure comprising:

a circular top wall portion defining an edge region, the top wall portion having a channel formed therein extending to the edge region defining an open end, the channel being defined by a pair of side walls and a bottom wall, the top wall portion further defining a dispensing opening therein at the channel bottom wall;

an annular skirt depending from the top wall portion at about the edge region, the skirt including a container engaging portion for engaging the container; and a cover pivotally connected to the top wall portion for movement within the channel between an open position wherein the cover is pivoted away from the dispensing opening and a closed position wherein the cover overlies the dispensing opening.

2. The closure in accordance with claim 1 including engaging elements formed on the top wall portion and engaging elements formed on the cover for securing the cover in the open position and in the closed position.

3. The closure in accordance with claim 2 wherein the cover engaging elements include a projection extending from a side of the cover, and wherein the top wall portion engaging elements include a first cooperating channel projection formed in the channel wall to secure the cover in the open position and a second channel projection formed in the channel side wall spaced from the first channel projection to secure the cover in the closed position.

4. The closure in accordance with claim 2 wherein the top wall portion engaging elements and the cover engaging elements are configured to provide audible indication of engagement and disengagement with one another when the cover is urged into and out of the open position.

5. The closure in accordance with claim 2 wherein the top wall portion engaging elements and the cover engaging elements are configured to provide audible indication of engagement and disengagement with one another when the cover is urged into and out of the closed position.

6. The closure in accordance with claim 1 wherein the cover is connected to the top wall portion by a pair of hinge pins extending outwardly from the cover and a pair of recesses formed in the side walls of the channel for receiving the hinge pins.

7. The closure in accordance with claim 6 wherein the hinge receiving recesses formed in the side walls channel are sealed.

8. The closure in accordance with claim 1 wherein the channel defines a closed end spaced from the open end, and the cover is positioned within the channel so as to extend to the edge region of the top wall portion at the open end when in the closed position and when pivoted to the open position the cover extends to a location within the channel spaced from the closed end.

9. The closure in accordance with claim 1 wherein the top wall portion has a generally domed shape, sloping downwardly circumferentially at about the edge region, and wherein the cover has a complementary shape so as to slope downwardly at an end toward the edge region when in the closed position.

10. The closure in accordance with claim 1 wherein when in the open position, the end of the cover, extends upwardly from the bottom wall of the channel to define a gap between the end of the cover and the channel bottom wall.

11. The closure in accordance with claim 1 wherein the closure defines a recessed region at about a juncture of the top wall portion and the skirt, adjacent to and below the cover when in the closed position to define a gap between the juncture and the cover.

12. The closure in accordance with claim 1 wherein the dispensing opening has a predetermined shape, and wherein the cover includes a sealing element extending therefrom having a shape complementary to the shape of the dispensing opening.

13. The closure in accordance with claim 12 wherein the dispensing opening has an upwardly extending lip for sealing engagement with the cover sealing element.

14. The closure in accordance with claim 1 wherein the cover pivots about an axis that is off-center from and parallel to a line extending across a diameter of the closure.

* * * * *